United States Patent [19]

Medovar et al.

[11] 3,992,564

[45] Nov. 16, 1976

[54] ELECTROSLAG REMELTING PLANT

[76] Inventors: Boris Izrailevich Medovar, ulitsa Anri Barbjusa, 22/26, kv. 109; Jury Fedorovich Alferov, bulvar Lepse, 29, kv. 64; Viktor Leonidovich Artamonov, ulitsa Shumskaya, 8a, kv. 90; Mikhail Elevich Berezovsky, ulitsa Lomonosova, 21/14; Alexei Georgievich Bogachenko, ulitsa Miljutenko, 15/2, kv. 141, all of Kiev, U.S.S.R.

[22] Filed: Jan. 3, 1975

[21] Appl. No.: 538,248

Related U.S. Application Data

[63] Continuation of Ser. No. 437,376, Jan. 28, 1974, abandoned, which is a continuation of Ser. No. 378,903, July 13, 1973, abandoned.

[52] U.S. Cl. ..... 13/16

[51] Int. Cl.[2] ..... H05B 7/103

[58] Field of Search ..... 13/9 ES, 14–17

[56] References Cited

UNITED STATES PATENTS

| | | | |
|---|---|---|---|
| 3,709,997 | 1/1973 | Medovar et al. | 13/9 ES |
| 3,738,825 | 6/1973 | Medovar et al. | 13/9 ES |

*Primary Examiner*—R. N. Envall, Jr.
*Attorney, Agent, or Firm*—Holman & Stern

[57] ABSTRACT

An electroslag remelting plant comprises a cooled mould with a base plate mounted on a car, and an electrode holder secured to a stringer with the help of a carriage. The electrode holder incorporates a standard head made up of two parts isolated from each other, each being adapted for holding in place at least one electrode and secured in the electrode holder so that each part contacts an appropriate contact plate of the electrode holder, the contact plates being connected to unlike poles of a power supply source.

1 Claim, 3 Drawing Figures

ELECTROSLAG REMELTING PLANT

This is a continuation of Ser. No. 437,376 filed Jan. 28, 1974 which is in turn a continuation of Ser. No. 378,903 filed July 13, 1973, both abandoned.

BACKGROUND OF THE INVENTION

The present invention relates to electroslag remelting plants employed in electrometallurgy in the production of high-grade steels and alloys by the electroslag remelting of consumable electrodes in cooled moulds.

An electroslag remelting plant is known in the art comprising a stringer with a top and bottom carriages secured to it to allow their vertical transfer. Fastened to the top carriage is an electrode holder with contact plates isolated from each other and from the body of the electrode holder and connected to one of the poles of a power supply source. The bottom carriage mounts a cooled mould under which a base plate is set up connected to another pole of the power supply source and secured on a car provided with a drive adapted to transfer it in a horizontal direction. The electrode holder is adapted for holding in place one electrode and supplying current to it with the aid of its contact plates.

However, in case the above plant is to be utilized for remelting two consumable electrodes connected in series into an electric circuit (a bifilar circuit), the electrode holder adapted for holding in place one electrode must be substituted by one suitable for holding two electrodes, and an electric current must be supplied to them from unlike poles of the power supply source.

The replacement of the electrode holder is a labor consuming operation requiring much time.

Attempts were made to provide a plant suitable for operation with several electrodes connected either according to a single-phase or a bifilar circuit. The plant is provided with a device for shifting a current lead from a base plate to the electrode holder.

However, the above plant requires an electrode holder of an intricate design adapted for holding in place two or more electrodes and fitted with individual clamps for each electrode.

SUMMARY OF THE INVENTION

The principal object of the invention is to provide an electroslag remelting plant which will allow remelting circuit or two consumable electrodes connected in series into an electric circuit according to a bifilar circuit.

These and other objects are accomplished by providing an electroslag remelting plant comprising a stringer with a cooled mould and an electrode holder with contact plates secured to the stringer so as to allow their vertical travel, the contact plates being coupled to a power supply source, a mould base plate mounted on a car carried horizontally, wherein, according to the invention, provision is made of a standard head made up of two parts isolated from each other, each part being adapted for holding in place at least one electrode and being so secured in the electrode holder that each of its parts contacts an appropriate contact plate of the electrode holder, the contact plates being connected to unlike poles of the power supply source.

The electroslag remelting plant with the above-described electrode holder furnished with the detachable standard head allows remelting two consumable electrodes connected in series into an electric circuit according to a bifilar (electrode-electrode) circuit.

BRIEF DESCRIPTION OF THE DRAWINGS

The present invention will be better understood from a consideration of a detailed description of an exemplary embodiment when read in conjunction with the accompanying drawings, wherein.

DESCRIPTION OF THE PREFERRED EMBODIMENT

Figure 1:
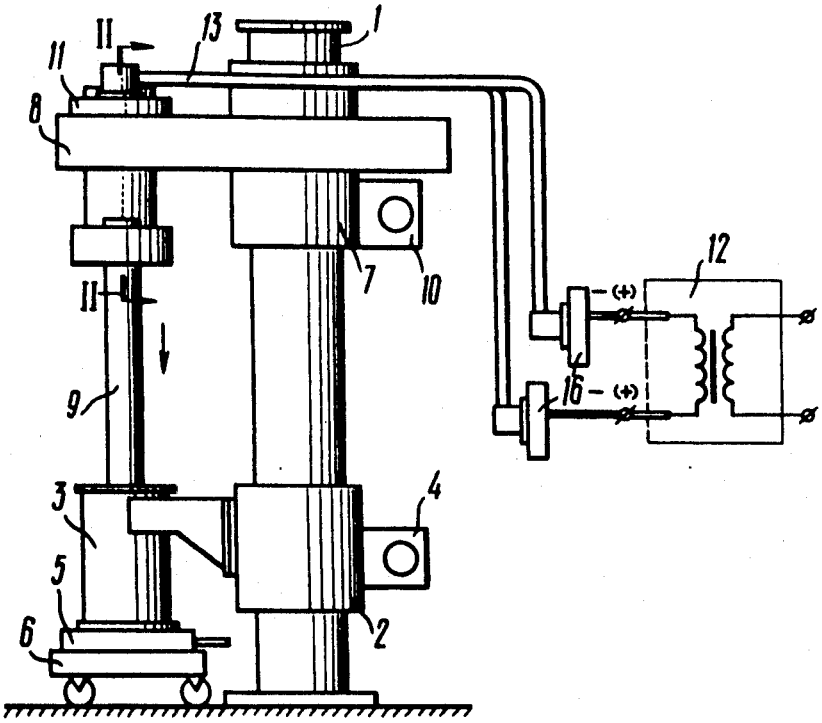
FIG. 1 shows a side elevation view of a plant, according to the invention, operating according to an electrode-electrode circuit.

An electroslag remelting plant comprises a stringer 1 (FIG. 1) to which a bottom carriage 2 is fastened with a cooled mould 3 fitted with a drive 4 adapted to reciprocate the carriage 2 vertically along the stringer 1. Under the cooled mould 3, there is provided a base plate 5 set up on a car 6 furnished with a drive for carrying it in a horizontal direction (not shown in the drawing). Mounted in the top portion of the stringer 1 is a second carriage 7 carrying an electrode holder 8 with consumable electrodes 9. The carriage 7 is also provided with a drive 10 ensuring its travel in a vertical direction along the stringer 1. The electrode holder 8 incorporates contact plates 11 connected to a power supply source 12 through current-carrying cables 13.

Figure 2:
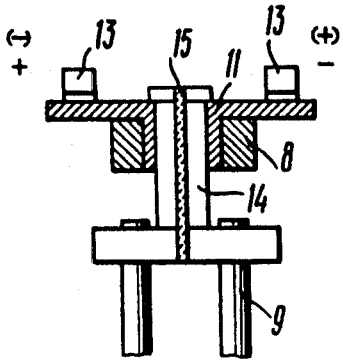
FIG. 2 depicts a standard head, section II—II by a vertical plane along the longitudinal axis of FIG. 1.
Figure 3:
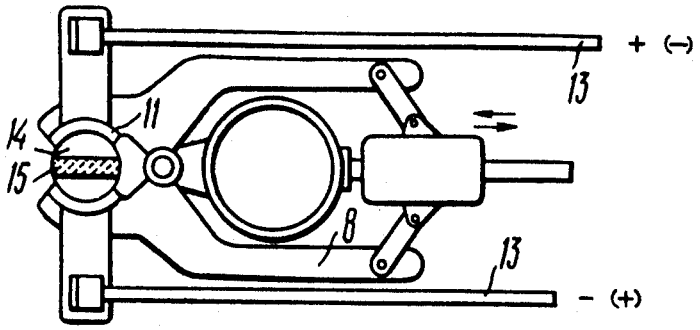
FIG. 3 is a plan view of the same standard head and electrode holder.

The electrode holder 8 incorporates a standard head 14 (FIGS. 2 and 3) secured in the holder and made up of two parts separated from each other with a gasket 15 produced, for example, from glass fabric or asbestos. Each part of the standard head 14 is adapted for holding in place at least one consumable electrode 9. The standard head is so attached that each of its parts contacts an appropriate contact plate 11 of the electrode holder 8, the plates 11 being connected to unlike poles 16 of the power supply source 12.

The parts of the standard head 14 can be either bolted together or clamped with the aid of collars (not shown in the drawing) isolated electrically from the standard head.

The electroslag remelting plant operates as follows;

At least one consumable electrode 9 is fastened to each part of the standard head 14 of the electrode holder 8.

When operating according to a bifilar circuit, the current-carrying cables 13 (FIG. 1) coupled with one end to the contact plates 11 of the electrode holder 8 are connected with their other ends to the unlike poles 16 of the power supply source 12.

The cooled mould 3 is mounted on the base plate 5 and the consumable electrodes 9 are introduced into the mould. Then the molten slag is effected by pouring slag until the lower part of the consumable electrodes 9 is immersed into it. Next, an electric current is passed to the electrodes 9. The current flows through a slag layer, heat is liberated and electrode ends submerged in the slag melt off. Liquid metal flowing in droplets off the electrodes builds up in the bottom portion of the mould 3 on the base plate 5 and forms an ingot when crystallizing. After the melting process is over, the ingot is withdrawn from the cooled mould 3.

Hence, in the above described plant for the electroslag remelting of consumable electrodes the remelting process can be accomplished by making use of a bifilar circuit.

What is claimed is:

1. A plant for electroslag remelting of consumable electrodes connected in a bifilar circuit, the plant comprising: a stringer; a bottom carriage being secured on the stringer so that it is free to travel in a vertical direction; a cooled mould being fastened to the bottom carriage and having a base plate positioned thereunder; drive means for transferring the bottom carriage in a vertical direction; a car having the base plate mounted thereon; drive means for transferring the car in a horizontal direction; a top carriage being secured on the stringer; an electrode holder having contact plates adapted to hold a single electrode therebetween and mounted on the top carriage; drive means for transferring the top carriage in a vertical direction; an electric power supply source having unlike poles thereof connected to the contact plates of the electrode holder; and a standard head for holding at least two consumable electrodes made up of two parts electrically isolated from each other, each of the parts being adapted for holding in place at least one of the two consumable electrodes and the standard head being secured in the electrode holder so that each of the parts contacts a respective contact plate of the electrode holder.

* * * * *

UNITED STATES PATENT OFFICE

CERTIFICATE OF CORRECTION

Patent No. 3,992,564 Dated Nov. 16, 1976

Inventor(s) Boris Izrailevich Medovar, et al.

Figure 4:
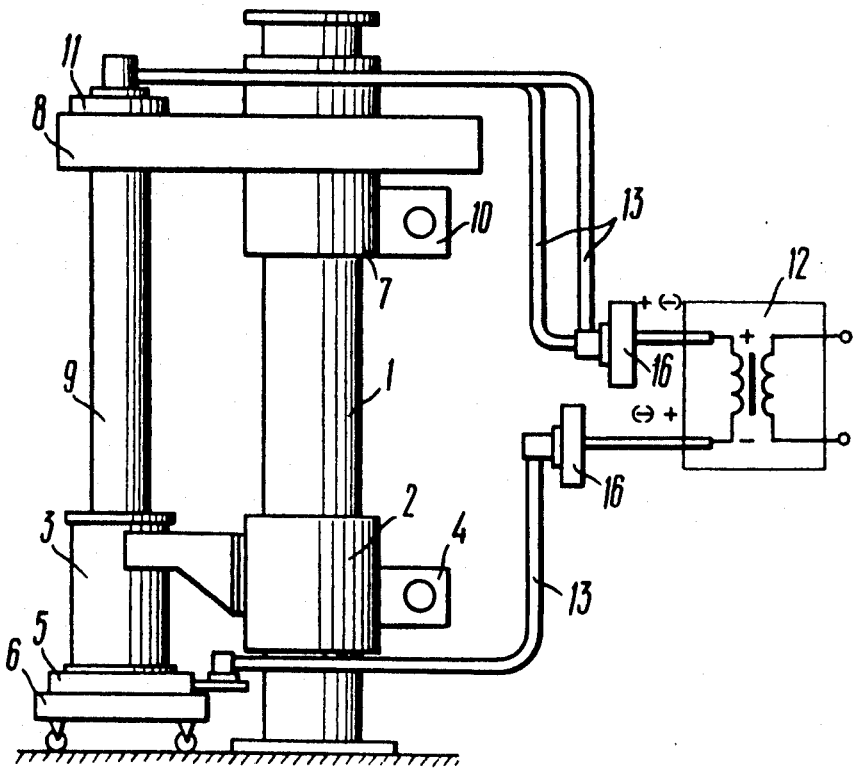

It is certified that error appears in the above-identified patent and that said Letters Patent are hereby corrected as shown below:

Figure 4 drawing is to be deleted.

Signed and Sealed this

Fourteenth Day of June 1977

[SEAL]

*Attest:*

RUTH C. MASON
*Attesting Officer*

C. MARSHALL DANN
*Commissioner of Patents and Trademarks*